US010926573B2

(12) United States Patent
Endres et al.

(10) Patent No.: US 10,926,573 B2
(45) Date of Patent: Feb. 23, 2021

(54) PRODUCING AN OPTICAL SECURITY ELEMENT

(71) Applicant: GIESECKE+DEVRIENT MOBILE SECURITY GMBH, Munich (DE)

(72) Inventors: Günter Endres, Munich (DE); Klaus Kohl, Miesbach (DE); Martin Imhof, Munich (DE)

(73) Assignee: GIESECKE+DEVRIENT MOBILE SECURITY GMBH, Munich (DE)

( * ) Notice: Subject to any disclaimer, the term of this patent is extended or adjusted under 35 U.S.C. 154(b) by 0 days.

(21) Appl. No.: 16/485,011

(22) PCT Filed: Feb. 9, 2018

(86) PCT No.: PCT/EP2018/000056

§ 371 (c)(1),
(2) Date: Aug. 9, 2019

(87) PCT Pub. No.: WO2018/145814

PCT Pub. Date: Aug. 16, 2018

(65) Prior Publication Data

US 2020/0039278 A1 Feb. 6, 2020

(30) Foreign Application Priority Data

Feb. 10, 2017 (DE) ..... 10 2017 001 348.9

(51) Int. Cl.
*B42D 25/328* (2014.01)
*B42D 25/324* (2014.01)
(Continued)

(52) U.S. Cl.
CPC ..... *B42D 25/328* (2014.10); *B42D 25/324* (2014.10); *B42D 25/373* (2014.10);
(Continued)

(58) Field of Classification Search
CPC .. B42D 25/328; B42D 25/373; B42D 25/455; B42D 25/48; B42D 25/378; B42D 25/324; B42D 25/46
(Continued)

(56) References Cited

U.S. PATENT DOCUMENTS 7,907,339 B2 3/2011 Tompkin et al.
9,975,370 B2 5/2018 Karrer Walker et al.
(Continued)

FOREIGN PATENT DOCUMENTS

AU 2016100402 A4 5/2016
DE 102004042136 A1 3/2006
(Continued)

OTHER PUBLICATIONS

German Search Report from DE Application No. 102017001348.9, dated Oct. 23, 2017.
(Continued)

*Primary Examiner* — Justin V Lewis
(74) *Attorney, Agent, or Firm* — Workman Nydegger

(57) ABSTRACT

The present invention is directed to a method for supplying an optical security element in a value document, as well as to an accordingly devised apparatus for adjusting an optical security element as well as to the value document per se. According to the invention a method is proposed which makes it possible to supply a known optical security element in an especially simple technical way, without a vapor deposition of embossed structures being necessary in this connection. Further the present invention is directed to a computer program product having control commands, which executes the method or operates the proposed apparatus.

14 Claims, 13 Drawing Sheets

(51) Int. Cl.

| | |
|---|---|
| ***B42D 25/373*** | (2014.01) |
| ***B42D 25/378*** | (2014.01) |
| ***B42D 25/455*** | (2014.01) |
| ***B42D 25/46*** | (2014.01) |
| ***B42D 25/48*** | (2014.01) |

(52) U.S. Cl.
CPC ..... *B42D 25/378* (2014.10); *B42D 25/455* (2014.10); *B42D 25/46* (2014.10); *B42D 25/48* (2014.10)

(58) Field of Classification Search
USPC ..... 283/67, 70, 72, 74, 75, 94, 98, 109, 110, 283/901
See application file for complete search history.

(56) References Cited

U.S. PATENT DOCUMENTS

2007/0164558 A1* 7/2007 Wicker ..... B41M 3/146 283/94
2008/0094713 A1* 4/2008 Tompkin ..... G03H 1/0244 359/576
2017/0066279 A1 3/2017 Karrer Walker et al.
2017/0217242 A1 8/2017 Lochbihler

FOREIGN PATENT DOCUMENTS

| | | | |
|---|---|---|---|
| DE | 112009002538 | T5 | 9/2011 |
| DE | 102014011425 | A1 | 2/2016 |
| EP | 2639077 | A1 | 9/2013 |
| WO | 2010042999 | A1 | 4/2010 |
| WO | 2013186167 | A2 | 12/2013 |
| WO | 2015169895 | A1 | 11/2015 |
| WO | 2016170132 | A1 | 10/2016 |

OTHER PUBLICATIONS

International Search Report from PCT Application No. PCT/EP2018/000056, dated May 16, 2018.

* cited by examiner

PRODUCING AN OPTICAL SECURITY ELEMENT

BACKGROUND

The present invention is directed to a method for supplying an optical security element in a value document, as well as to an accordingly devised apparatus for supplying an optical security element as well as to the value document per se. According to the invention a method is proposed which makes it possible to supply a known optical security element in an especially simple technical way, without a vapor deposition of embossed structures being necessary in this connection. Further the present invention is directed to a computer program product having control commands, which executes the method or operates the proposed apparatus.

DE 10 2004 042 136 A1 shows a method for manufacturing a security element in the form of a multilayer foil body, wherein a metal layer is applied to a lacquer layer by a thermal vapor deposition.

DE 10 2014 011 425 A1 shows a security element for the manufacture of value documents, such as bank notes, checks or the like, wherein a hologram is provided as well as a thermal evaporation.

WO 2015 169 895 A1 shows a method for manufacturing a multilayer body, in particular a security element, with a generating of a metal layer which is generated such that a vapor deposition on a substrate is effected, wherein upon the vapor deposition a vacuum arises.

For value documents it is essential to incorporate security features which make it possible to verify a certain value document with respect to its authenticity such that features can be captured preferably with the naked eye. For this, so-called optical security elements are known which change with respect to a reflecting property depending on the viewing angle. Typically such optical security elements are configured such that an optical three-dimensional effect arises, and consequently a certain pattern has optically different layers. Consequently an image depth thus arises which varies slightly as soon as the viewing angle of a viewer changes.

Known methods generate an optical security element such that a substrate is supplied, and in a further, subsequent method step, a metal layer is vapor-deposited which can consist, for example, of silver. Such a vapor deposition or a metallic vapor deposition is a manufacture operation for which a great technical effort exists and in addition impairments of further foil layers can arise, because it is a thermal method.

Thus it is especially disadvantageous according to known methods that the known metallic layer has to be attached in a separate method step and consequently also a metal layer thus has to be supplied which is then incorporated in a card body. In this connection also the disadvantage arises that by means of the thermal of the vapor deposition the thin foils of a card body can be broken or at least varied, because the foil layers are layers whose materials change their properties under the impact of heat. This consequently has to be the case, because typically these card stacks are laminated together and consequently also shape a card body, for example a credit card. It is consequently possible that particularly for a large number of a production, individual foils are varied such that they do no longer correspond to the requested appearance and consequently a reject comes about.

Further the skilled person always tries hard to supply alternative or improved manufacturing methods within the scope of security features which not merely increase only the production efficiency, but also vary corresponding security features in general. This is therefore the case, because to some extent individual production steps can also be found in the end product and consequently in an existing value document or in an existing credit card it can consequently be verified whether this was also supplied according to a prescribed manufacturing method.

SUMMARY

It is consequently an object of the present invention to propose a method for supplying an optical security element in a value document, which differs from certain methods and can in particular be realized with a low technical effort. Further it is an object of the present invention to propose an accordingly devised apparatus as well as an accordingly equipped value document having an optical security element. Further it is an object of the present invention to supply a computer program product which has control commands which implement the proposed method or operate the proposed apparatus.

Accordingly, a method for supplying an optical security element in a value document with low technical effort is proposed, having a supplying of a foil stack having two consecutive transparent foils, a laminating of the foil stack for supplying a card body, wherein between the two transparent foils a silver ink and at least one structure layer are incorporated such that in the interaction with the two transparent foils, the optical security element has a three-dimensional optical impression.

The supplying of a foil stack as well as the laminating onto each other can advantageously be carried out according to conventional methods, wherein thus no technical changes have to be made to corresponding production equipment and production materials. The foil stack has at least two consecutive transparent foils which advantageously are configured such that these transparent foils are visible from outside of the card body. For example, these foils can be shaped as outwardly located protective layers. In this connection it is, however, also possible that further transparent or semi-transparent foils are provided. In this connection a foil stack is to be provided such that a layer construction of the card body arises which makes it possible to also inspect the incorporated optical security element from outside of the card body. This does not necessarily have be effected with the naked eye, wherein, however, this is especially preferable. Also conceivable would be translucent foil layers which make it possible for an optical reader to check the corresponding optical security element as to an authenticity. In this connection the skilled person recognizes that it is especially advantageous, however, if two consecutive transparent foils are arranged on an outer side of the card body.

The value document can preferably be a credit card, a smart card or in general an identity document. This can also be present according to the invention in a known format as is the case for conventional credit cards. In this connection it is further possible to introduce electronic components in further optional method steps which provide, for example, a microprocessor, a memory or an inductance coil. Thus the corresponding card stack can be extended to the effect that further layers or else further electronic components are inserted into the foil stack and are laminated together in a subsequent method step. This is therefore especially advantageous in particular because the proposed invention does not impair existing manufacturing methods and consequently an optical security element can be supplied in a value document in simple way independent of further method steps.

A silver ink and at least one structure layer are incorporated at or between the two transparent foils. This differs from known methods especially advantageously, because typically no silver ink is incorporated, but rather a metal layer. In this connection a silver ink has the advantage that it can be incorporated into the foil stack in a simple way and can in this connection represent any fine pattern. Consequently an image of very fine structures also becomes possible. With known methods, an image of very fine structures cannot be brought about by means of interference print over relief print. In addition, the achievable effect is in this connection possible only by the combination of more specifically optically variable colors with a dark relief lacquer which in the card construction always lies below the effect ink. Consequently there is effected according to the invention a simple generation of optical security elements located inside the card construction e.g. holographic images having high brilliance and good laminating stability, deviating from known processes of the embossing of, for example, UV lacquers with subsequent metal vapor deposition. Consequently a simple generation is effected of high-brilliance structures, located inside the card construction, having very pronounced relief character.

Consequently a combination of optically variable colors can be effected with relief lacquers set transparent or glazing colorfully and/or lacquers having embossed relief structures set transparent or glazing colorfully. Further possible is a combination of a silver ink having mirroring properties with relief lacquers set transparent or glazing colorfully and/or with lacquers having embossed relief structures set transparent or glazing colorfully.

The relief effect can thereby be generated by means of lamination directly by overprinting the optically variable ink or silver ink with the relief lacquer, transparently or glazing colorfully, or by transferring the relief lacquer or lacquers with embossed relief structures from a counterfoil which is equipped with the relief lacquer or the embossed structure. Consequently a simple generation of an impressive virtual 3D effect is possible by printing method or embossing technique. A simplified manufacture of optical security elements arises by means of screen printing technology without the elaborate process of the metallic vapor deposition of embossed structures.

An attaching of the silver ink and at least one structure layer to the two transparent foils can be effected such that the silver ink as well as the structure layer are attached to a single transparent foil, or attached between the foil layers such that these features are attached to the two transparent layers. In this connection it is normally possible in the context of the overall invention that merely one single transparent layer is provided which encloses the silver ink and the at least one structure layer with an opaque layer. Especially preferable, however, is an embodiment in which two transparent layers are provided, and the silver ink and the at least one structure layer are arranged between the two. A sequence is also conceivable in which an opaque layer is provided, then either the same ink or the structure layer whereupon in turn a transparent layer is effected whereupon either the silver ink or the structure layer is arranged and then in turn a transparent layer follows. Thus it is also conceivable that one of the two transparent layers is optional or the second transparent layer is a further protective layer on the back side of the card body. Consequently the skilled person recognizes how he or she attaches at least one structure layer and the silver ink advantageously to the transparent foils to generate an optical security element in this connection.

The interaction between the silver ink and the at least one structure layer is effected such that the structure layer pre-specifies a relief which is adapted with the silver ink such that the desired pattern of the optical security element comes about. Thus it is possible that the structure layer supplies the different areas of an optical security element and the silver ink provides merely ensures a reflective effect. In this connection, however, a mixing of the structure layer with the silver ink is also possible such that not two separate layers, thus a layer of silver ink and a structure layer are present, but rather that the silver ink and the structure layer form an individual layer. In this connection the skilled person recognizes that also two separate layers are possible in which the structure layer is subjected to the silver ink.

According to one aspect of the present invention the structure layer is supplied by means of a relief lacquer and/or an embossed layer. This has the advantage that elevations and depressions can arise in a different way such that a structure layer is formed which reflects the different areas of the optical security element. Thus it is possible, for example, to generate by means of a relief lacquer a three-dimensional lettering or a pattern which protrudes from the printed base, for example a transparent foil. Consequently a three-dimensional relief actually arises onto which then the silver ink can be applied directly or indirectly. For a relief lacquer a screen printing is suitable by which a high layer thickness can be attained and in particular the layer thickness can be varied, where applicable, in further processing steps. Consequently a three-dimensional pattern arises which ultimately corresponds to the pattern of the optical security element. In this connection it is, however, also possible to employ another structure element such that this is embossed or thermally shaped and consequently a structure is likewise supplied which with the silver ink supplies an optical security element.

According to a further aspect of the present invention, the silver ink is incorporated into the structure layer. This has the advantage that the silver ink can be mixed, for example, with a relief lacquer such that a single layer shapes which comprises the silver ink and further structure elements. Normally the silver ink can consist of a carrier material which is preferably liquid or gel-like, and in addition have further effect inks which bring about the silver ink or a color reflex. Consequently a relief can thus be supplied into which the silver ink is already incorporated.

According to a further aspect of the present invention, an effect ink is incorporated between the transparent foils. This has the advantage that besides the silver ink also further design options exist which bring about a certain coloration or reflecting properties. Thus, for example, the silver ink can already be configured as an effect ink, wherein, however, it is also possible to incorporate further inks. Consequently reflecting properties as well as color properties can thus be adapted according to a customer wish. Consequently an especially forgery-proof optical security element, namely a hologram, can also be created for example.

According to a further aspect of the present invention, the structure layer is configured transparently or semi-transparently. This has the advantage that by this embodiment a further three-dimensional effect exists or the consisting three-dimensional effect is reinforced. Consequently with the help of fewer layers a deep three-dimensional effect can thus be brought about which is especially appealing or forgery-proof.

According to a further aspect of the present invention, the structure layer is configured as glazing in color. This has the advantage that this layer can be configured semi-transparently and in addition a color tone can be mixed which impairs the transparency of the structure layer substantially not strongly, different colorations are, however, possible in this connection. Consequently the optical security element can thus be dyed wholly or partly in color, which in turn not only looks appealing, but rather again provides a forgery-proof security element.

According to a further aspect of the present invention, the structure layer is provided as an embossed foil. An embossed foil has the advantage that, in this connection, a structure or a relief can easily be provided and consequently also the corresponding pattern can be supplied by means of an embossing such that the optical security element reflects the corresponding embossing.

According to a further aspect of the present invention, the structure layer is supplied while employing a relief printing. This has the advantage that by means of a simple printing method, a corresponding pattern can be applied to existing layers and in this connection conventional means of production can be used. The relief print can be effected such that only the structure layer is created and in a subsequent method step the silver ink is applied, or else that the relief print employs a relief lacquer into which the silver ink is already incorporated.

According to a further aspect of the present invention, the silver ink is incorporated into the card stack above or below the structure layer. This has the advantage that different embodiments of the optical security element are possible and in particular that consequently a different optical effect arises, e.g. that the optical security element has a three-dimensional optical impression upon viewing. As a result of this, a security feature is in turn created which has to correspond to a certain specification and it can consequently also be ascertained in circulating cards whether they were manufactured according to such pre-specifications.

According to a further aspect of the present invention, the optical security element is generated by means of the silver ink and/or by means of the structure layer. This has the advantage that individual properties of the optical security element are possible either only by means of the silver ink, only by means of the structure layer or else by a combination of the two, namely the silver ink and the structure layer. Thus a security feature has, for example, several regions which can then also be configured differently. Consequently the optical security element can partly have only a silver ink and at another place a structure layer as well as a silver ink. Consequently different patterns are possible which in turn impede a forgery.

According to a further aspect of the present invention, an outer transparent foil is configured with respect to the card body as a protective layer. This has the advantage that the transparent foil, which is provided according to the invention, can lie outside the card body such that this makes it possible for a viewer to see and to verify the optical security element having the three-dimensional impression upon viewing, e.g. in the form of a hologram. At the same time the card body is in this connection altogether protected from an action of force from outside and an especially robust card body arises, which grants insight onto the optical security element.

According to a further aspect of the present invention, the silver ink is incorporated by means of screen printing technology. This has the advantage that, similar as in a relief print, known means of production can again be employed and in particular that a structure can be supplied which corresponds to the pattern of the optical security element. The proposed screen printing method provides in this connection in turn a three-dimensional embodiment of the structure layer, so that the optical security element also has the desired three-dimensional effect.

The object is also achieved by a value document from a laminated foil stack having an optical security element, having two consecutive transparent foils, wherein at the two transparent foils a silver ink and at least one structure layer are incorporated such that in the interaction with the two transparent foils, the optical security element has a three-dimensional optical impression upon viewing. The incorporating of the silver ink and the at least one structure layer at the two transparent foils preferably follows between the two transparent or at least under a transparent foil in the interaction with an opaque layer.

The object is also achieved by an apparatus for supplying an optical security element in a value document with low technical effort, having a supplying unit devised for supplying a foil stack having two consecutive transparent foils, a lamination unit devised for laminating the foil stack for supplying a card body, wherein at the two transparent foils a silver ink and at least one structure layer are incorporated such that in the interaction with the two transparent foils, the optical security element has a three-dimensional optical impression. The value document is, e.g. a chip card, a credit card, a bank card, an identity card, a passport, a driving license, a social security identity card.

The object is also achieved by a computer program product having control commands which implement the proposed method or operate the proposed apparatus.

In this connection it is especially advantageous that the method proposes individual method steps which are executed by the proposed apparatus. Consequently the method steps are implemented respectively by the apparatus and are also accordingly reworked with suitable means. The method provides structural features which also find expression in the proposed value document. Thus the proposed method is suitable to produce the value document and is likewise suitable to operate the proposed apparatus. For this, the computer program product supplies control commands which correspond to the method steps or implement these computationally. Further the computer program can come into use in operating the proposed apparatus.

BRIEF DESCRIPTION OF THE DRAWINGS

Further advantageous embodiments are explained in more detail on the basis of the enclosed figures. There are shown.

DETAILED DESCRIPTION OF VARIOUS EMBODIMENTS

Figure 1:
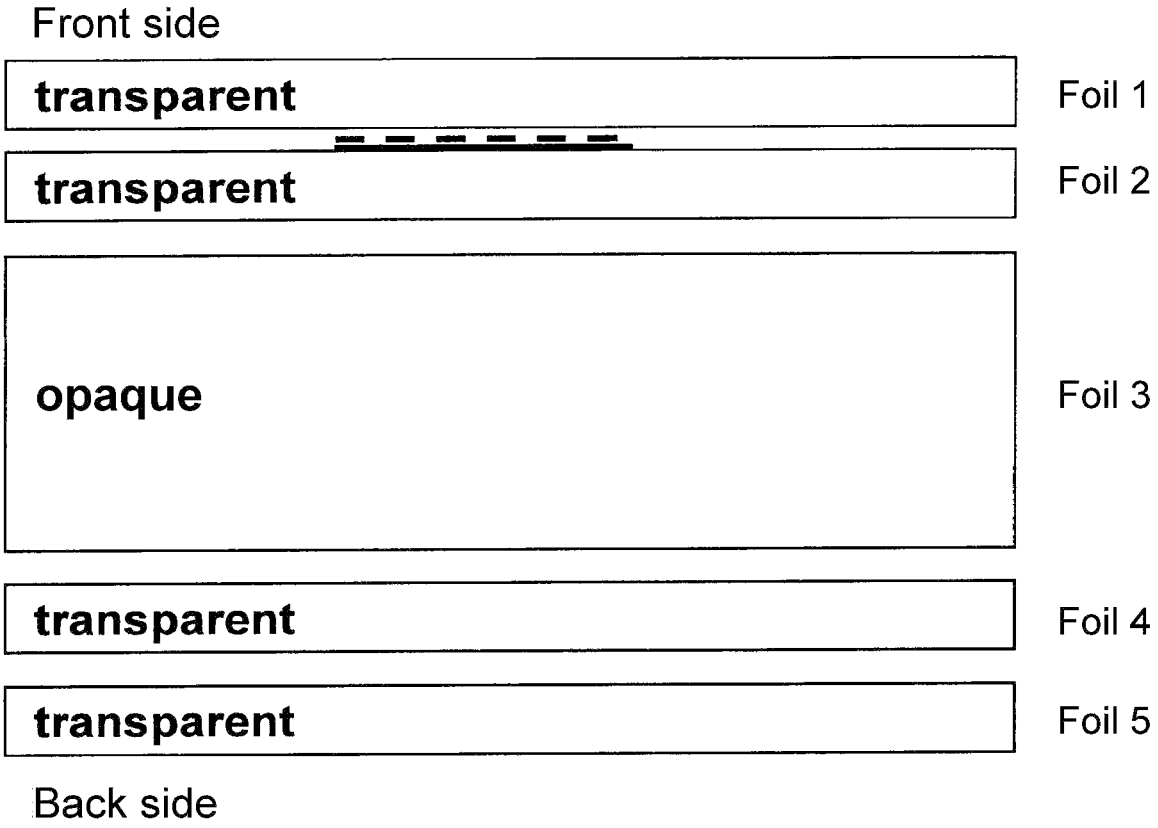
FIG. 1: an advantageous layer construction for generating an optical security element according to an aspect of the present invention.

FIG. 1 shows an laminated foil element having a transparent emboss lacquer which, for example, is laminated on a polycarbonate foil having previously printed silver. In this connection it is possible, for example, to partially demetallize the silver region by means of a laser. In the present FIG. 1, and unless stated otherwise in the further figures, a layer construction is indicated for which a front side of a card body is displayed above and a back side below. Consequently the representation is thus a cross-section along at least a section of e.g. a chip card or a credit card or an identification card or in general a value document. In this connection five layers are displayed in the present case by way of example, wherein the two uppermost and two lowermost layers are configured transparently. The middle layer is an opaque layer. An opaque layer can act as a carrier layer in this connection.

It is especially advantageous in the proposed construction that the continuous line between the uppermost and second transparent layer is a silver ink or an effect ink. The dashed line is a relief print. In the present case the silver ink is thus displayed as a continuous line below the uppermost transparent layer. Further, below the uppermost transparent layer, a structure layer, which resulted from a relief print, is drawn in by means of the dashed line. Consequently the silver ink and the structure layer thus form the desired optical security element having a three-dimensional optical impression upon viewing, e.g. a hologram.

The optical security element is therefore perceptible from outside the card body, because the transparent layers are arranged on a front side of the card body and are not covered by a further layer.

Figure 2:
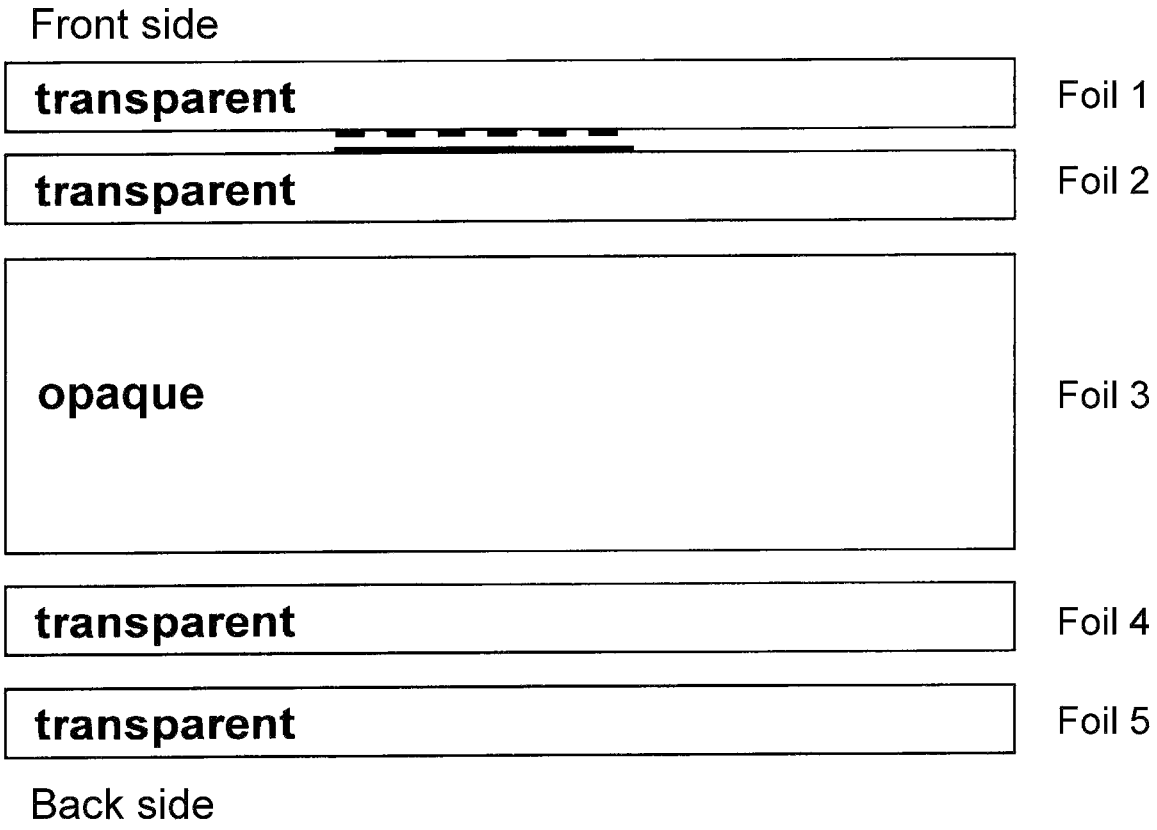
FIG. 2: an advantageous layer construction for generating an optical security element according to a further aspect of the present invention.

FIG. 2 shows a similar arrangement as is shown in FIG. 1, wherein now the silver ink, in the present case drawn in by means of a continuous line, is attached to the second foil from above, and the relief print, the present case drawn in by means of the dashed line, is attached to the first transparent foil. In contrast to this, FIG. 1 shows that both the relief print as well as the silver ink are arranged on the second foil from above. Consequently it is advantageous according to FIG. 2 that the uppermost transparent foil can be printed by means of relief print and independently thereof silver ink can be attached to the second-uppermost foil. Consequently the uppermost foil and the second uppermost foil can thus be supplied independently from each other and be laminated to each other in a subsequent method step. In this connection the skilled person recognizes that the relief print pre-specifies a certain pattern and the silver ink brings about a reflection. As a result of this, the desired optical security element arises.

Figure 3:
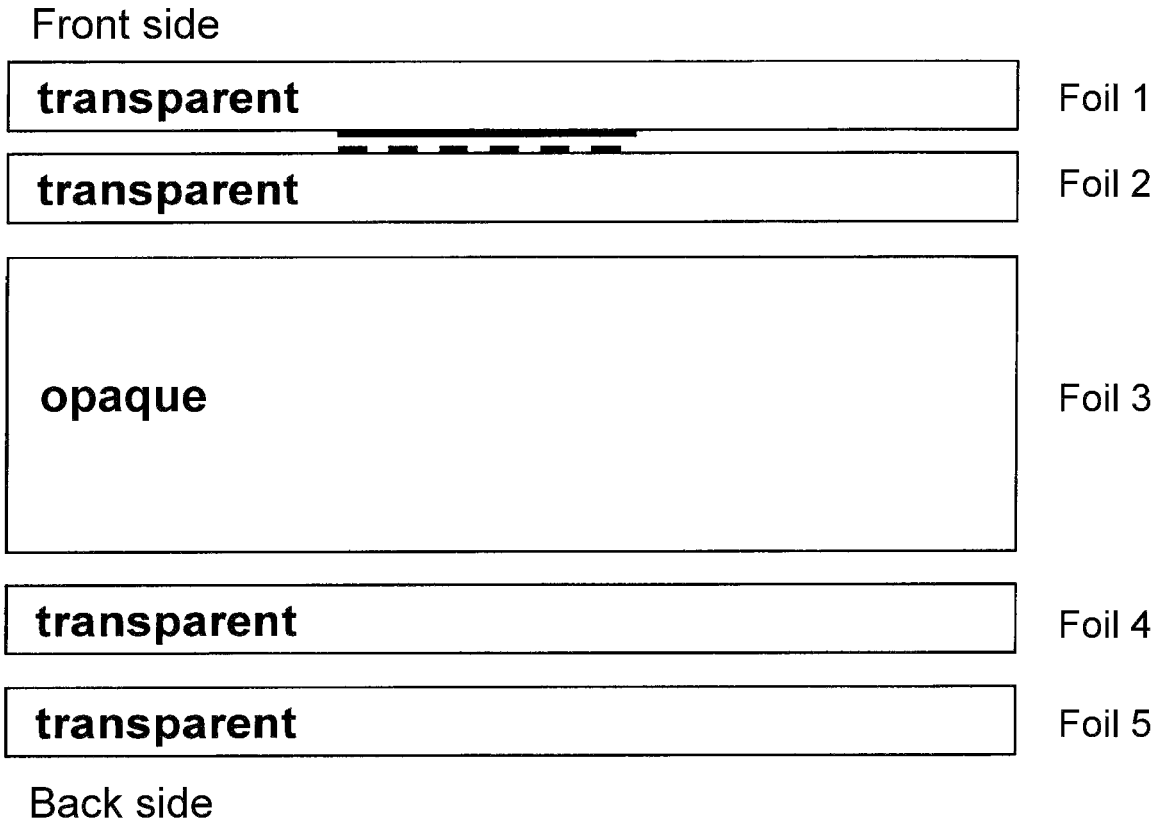
FIG. 3: a layer construction according to a further arrangement according to an aspect of the present invention.

FIG. 3 in turn shows a varied application, wherein now the silver ink or the effect ink is attached to the uppermost transparent foil. The relief print is attached to the second foil from above.

Figure 4:
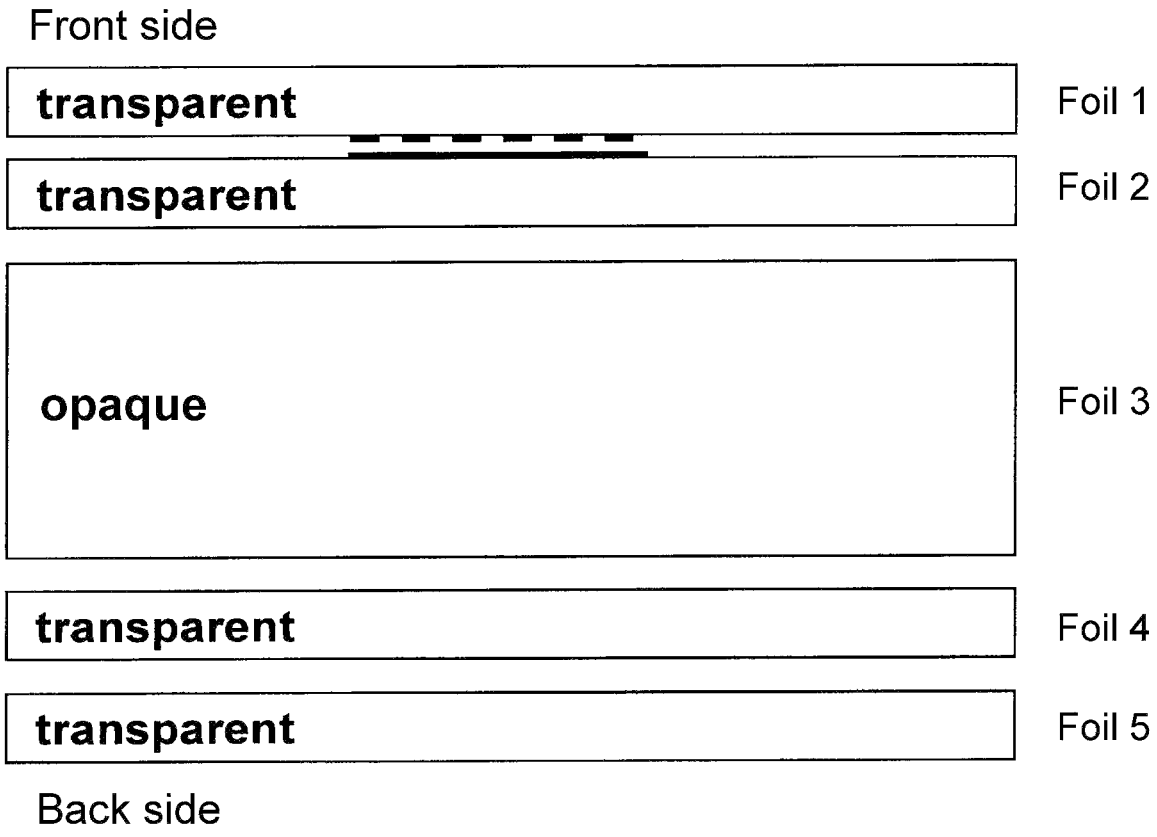
FIG. 4: an arrangement which provides an embossed structure according to a further aspect of the present invention.

FIG. 4 now shows an analog representation, wherein the now dashed line is an embossed structure which brings about the desired pattern of the optical security element.

Figure 5:
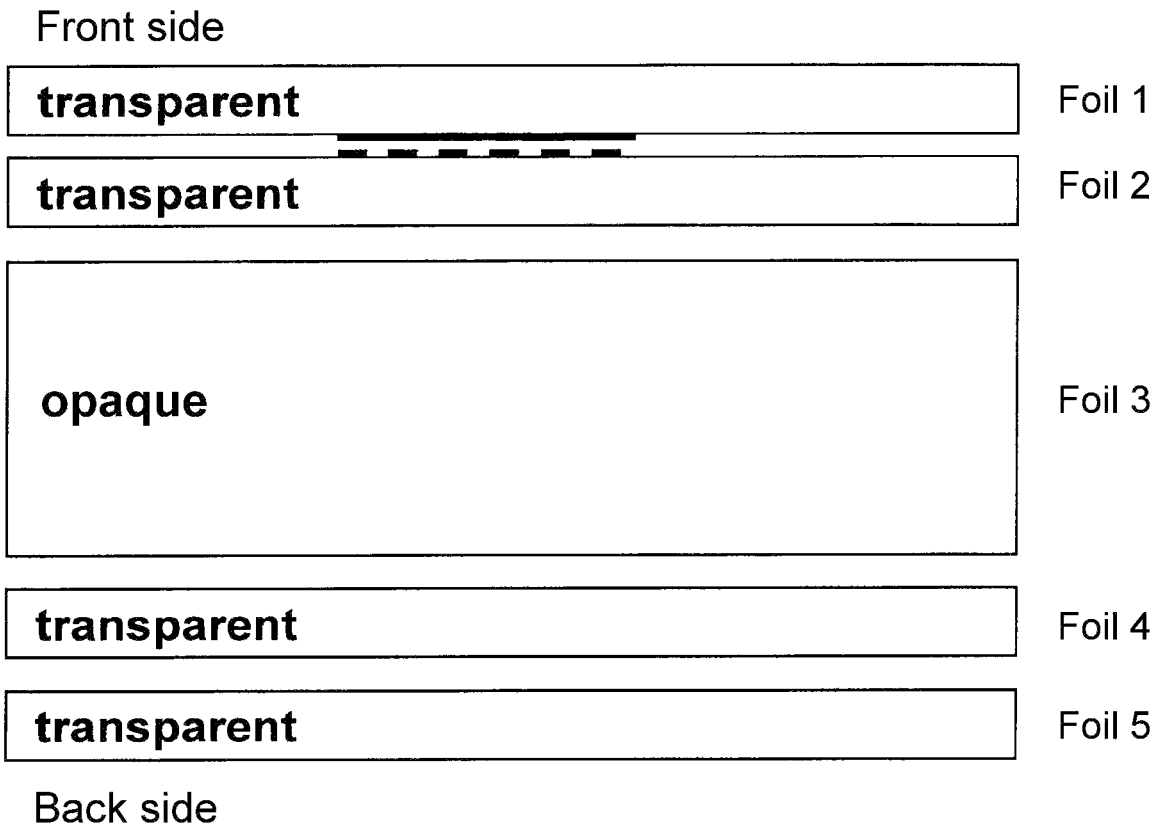
FIG. 5: a varied arrangement of the embossed structure according to a further aspect of the present invention.

FIG. 5 shows a similar embodiment as is shown in FIG. 4, wherein, however, the arrangement of the silver ink or effect ink and that of the embossed structure is inverted, so that now the silver ink is attached to the uppermost transparent layer.

Figure 6:
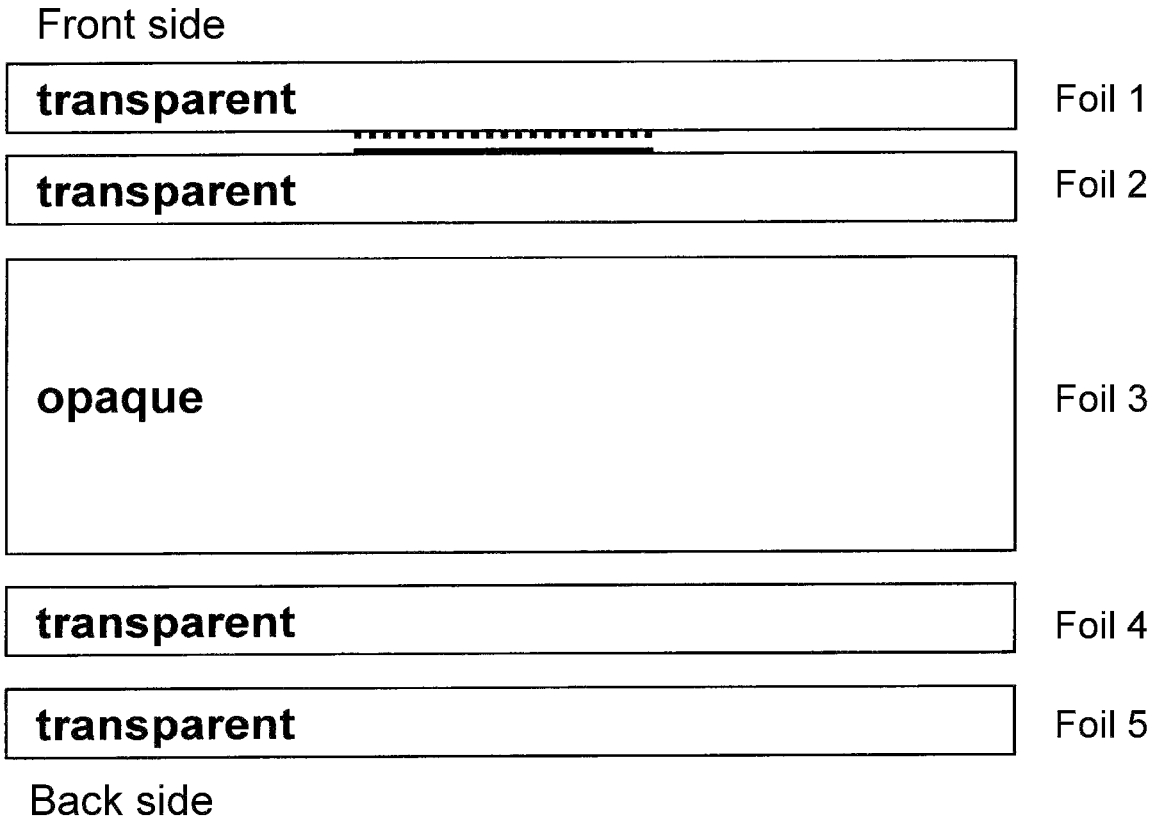
FIG. 6: the arrangement according to the invention with an embossed structure of the optical security element according to an aspect of the present invention.

FIG. 6 shows an embodiment example in which the dashed line is an embossed structure of the optical security element.

Figure 7:
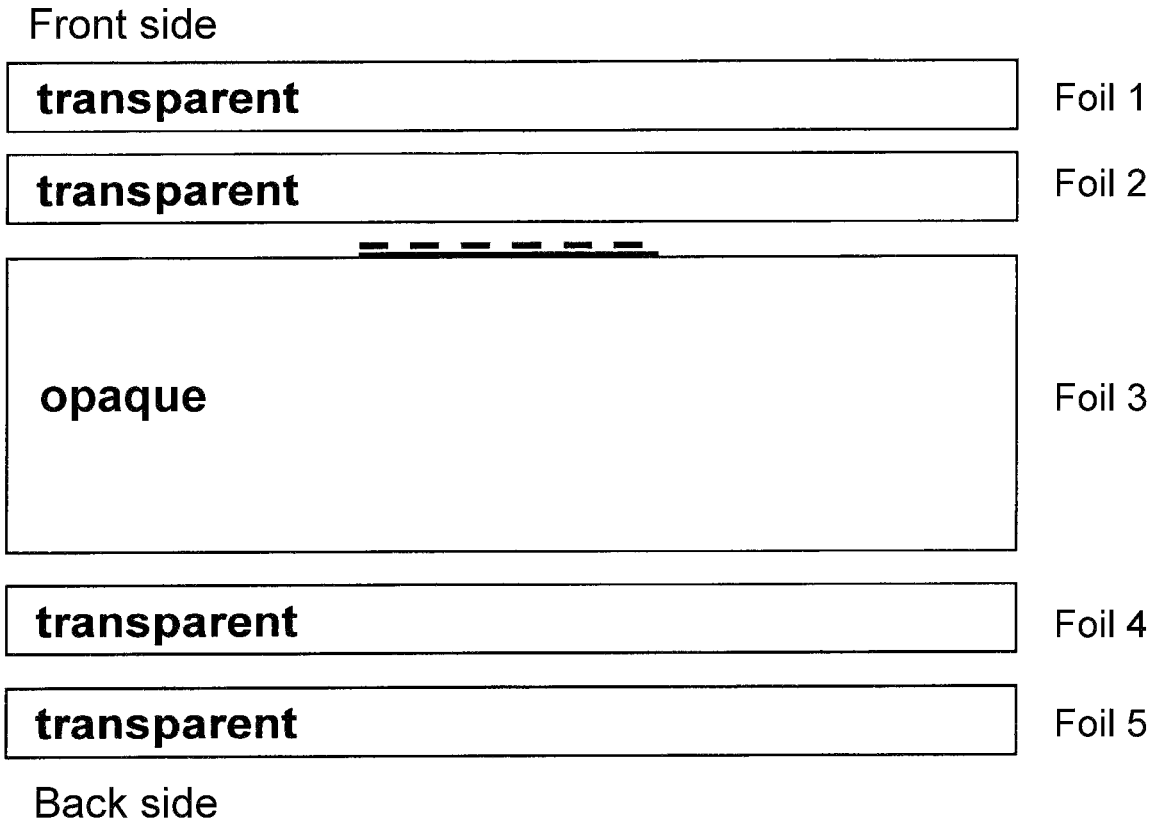
FIG. 7: a further arrangement of features according to the invention between a transparent and an opaque layer according to an aspect of the present invention.

FIG. 7 shows an analog arrangement, wherein the continuous line is a silver ink or an effect ink and a relief print is attached hereupon. As is evident in the present FIG. 7, the silver ink or the structure layer is now attached to the two transparent foils such that these elements are attached below the two foils and in addition the opaque layer is used for this.

Figure 8:
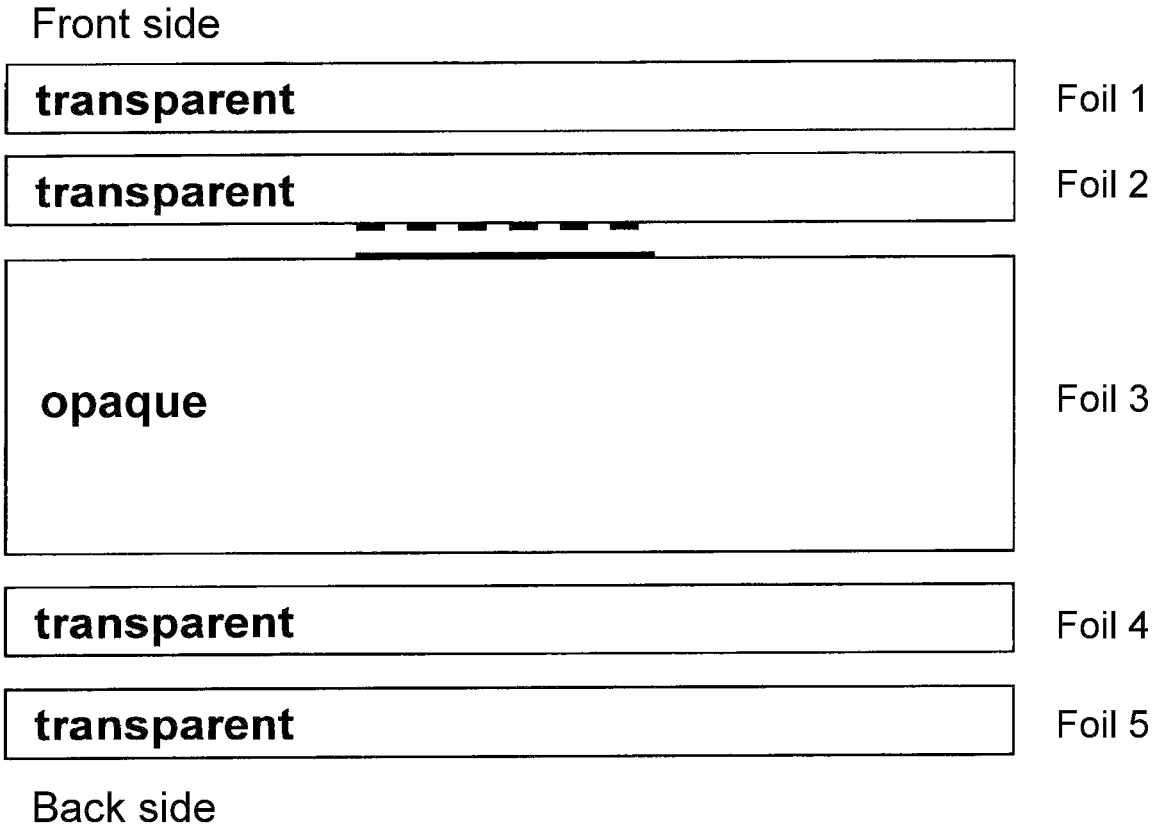
FIG. 8-12: respectively a further arrangement of features according to the invention according to a further aspect of the present invention.

FIG. 8 shows an analog arrangement to FIG. 7 and shows with the continuous line the silver ink or the effect ink, and with the dashed line the relief print.

Figure 9:
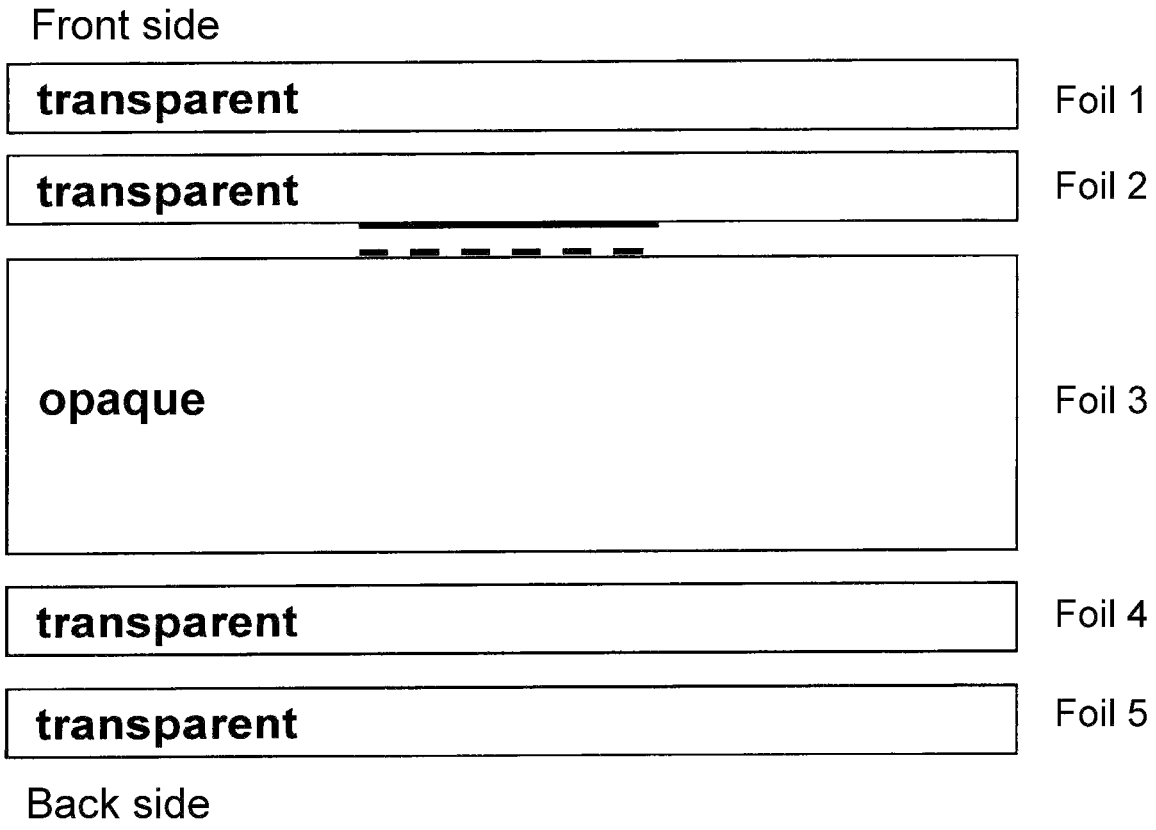

FIG. 9 shows an alternative embodiment, wherein the continuous line shows the silver ink or the effect ink and the dashed line the relief print. Here, too, those elements which supply the optical security element are arranged below the transparent foils, wherein the silver ink or the effect ink is arranged on a transparent foil and the relief print on the opaque foil.

Figure 10:
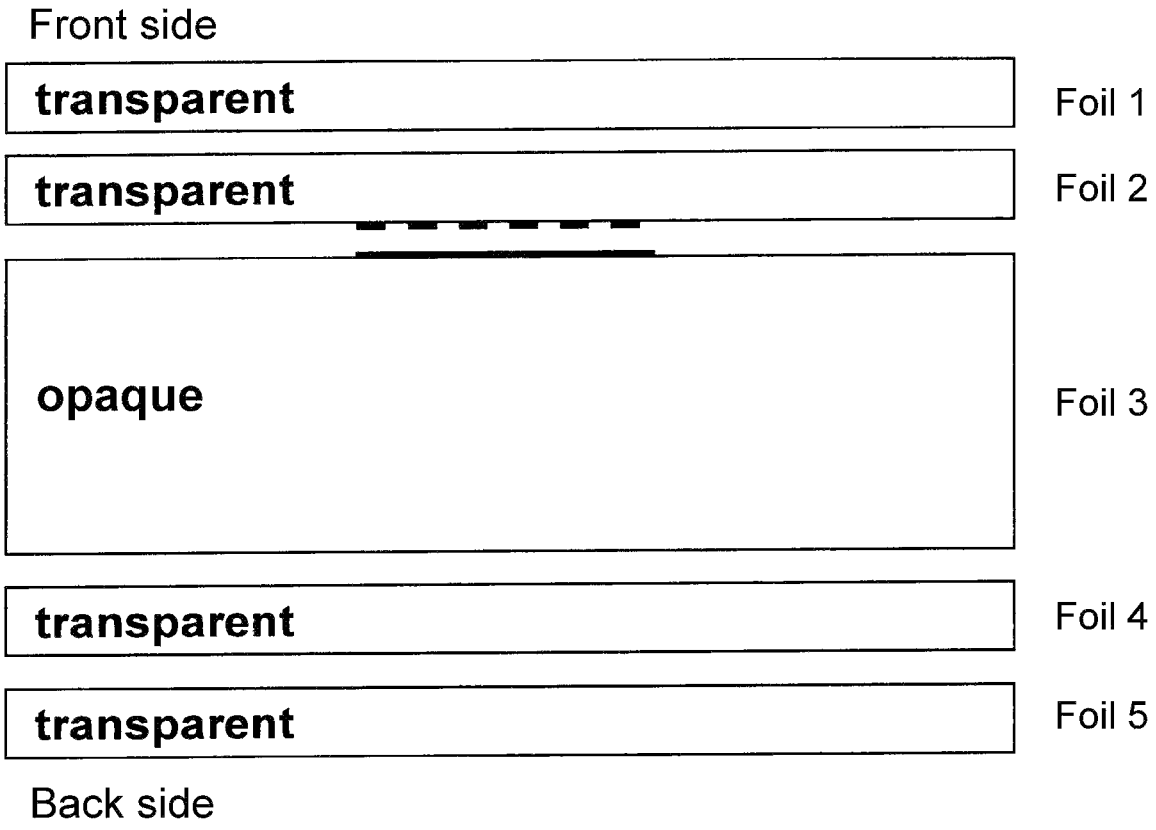

FIG. 10 shows an alternative embodiment, wherein the continuous line shows the silver ink or the effect ink and the dashed line an embossed structure.

Figure 11:
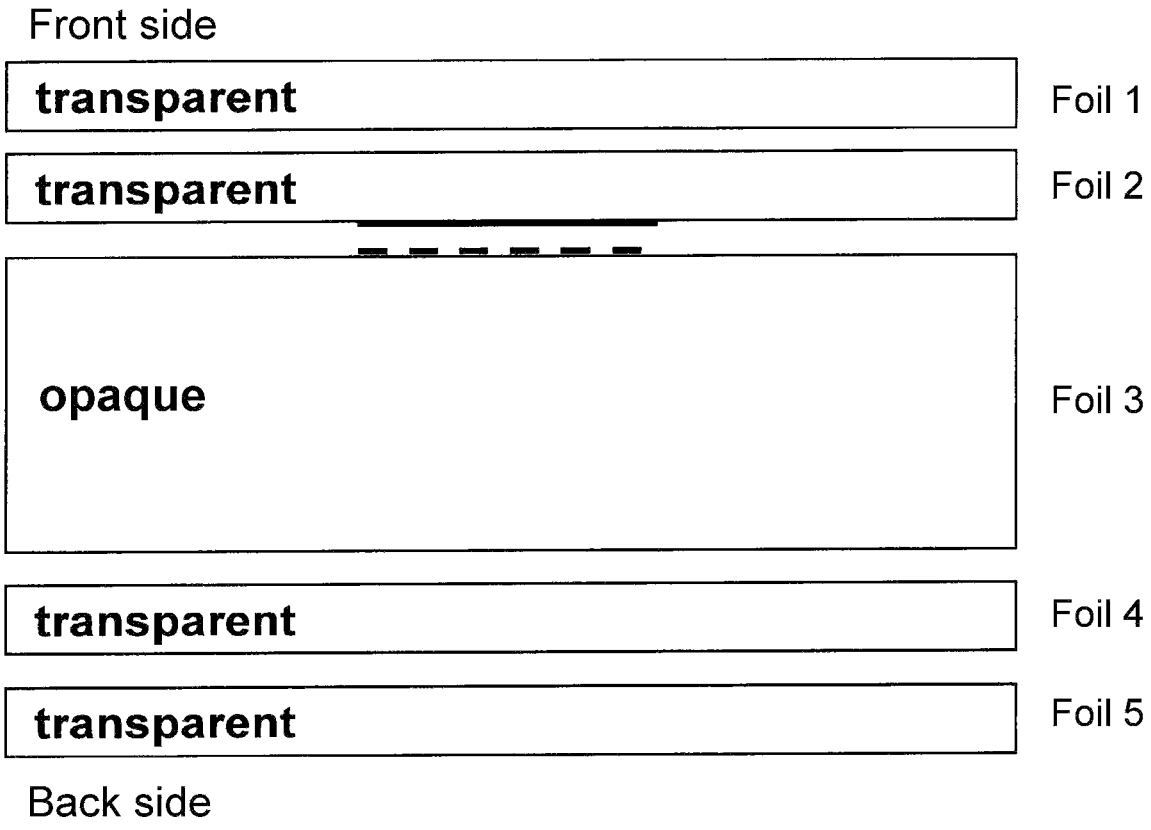

FIG. 11 shows, by means of the continuous line, a silver ink or an effect ink and, by means of the dashed line, an embossed structure, wherein the arrangement of the two elements with respect to FIG. 10 is inverted.

Figure 12:
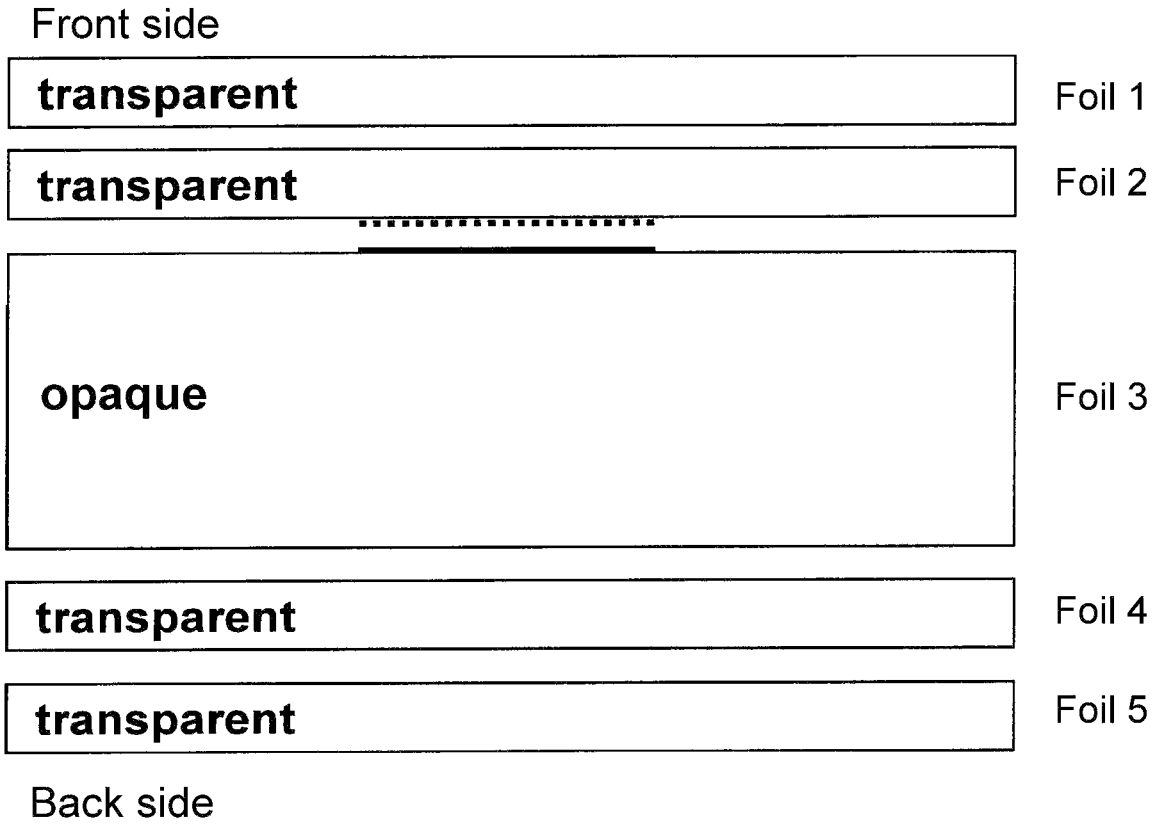

FIG. 12 shows, by means of the continuous line, a silver ink and, by means of the dashed line, an embossed structure of the optical security element, e.g. of a hologram.

Consequently a plurality of possibilities is taught to the skilled person how he or she can arrange the silver ink or the structure layer with respect to the transparent foils. This, however, is not an exhaustive enumeration, but rather the average skilled person recognizes further possibilities how he or she arranges the silver ink and the at least one structure layer with respect to the transparent foils to create a very appealing or forgery-proof optical security element.

Figure 13:
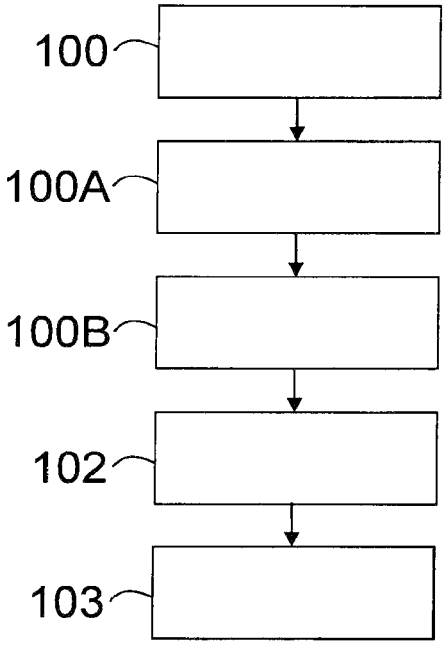
FIG. 13: a flowchart of a method for supplying an optical security element according to one aspect of the present invention.

FIG. 13 shows a flowchart of a method for supplying an optical security element, e.g. a hologram, in a value document with low technical effort, with a supplying 100 of a foil stack having two consecutive transparent foils, a laminating 101 of the foil stack for supplying a card body, wherein at the two transparent foils a silver ink is incorporated 100A and at least one structure layer is incorporated 100B such that in the interaction with the two transparent foils, the optical security element has a three-dimensional optical impression upon viewing 102.

The invention claimed is:

1. A method for supplying an optical security element in a value document, having:

supplying a foil stack having two consecutive transparent foils, laminating the foil stack for supplying a card body, wherein a silver ink and at least one structure layer are incorporated at the two transparent foils such that in interaction with the two transparent foils, the optical security element has a three-dimensional optical impression upon viewing, and wherein the silver ink is incorporated into the at least one structure layer.

2. The method according to claim 1, wherein the structure layer is supplied by means of a relief lacquer and/or an embossed layer.

3. The method according to claim 1, wherein an effect ink is incorporated between the transparent foils.

4. The method according to claim 1, wherein the structure layer is configured to be transparent or semi-transparent.

5. The method according to claim 1, wherein the structure layer is configured as glazing in color.

6. The method according to claim 1, wherein the structure layer is provided as an embossed foil.

7. The method according to claim 1, wherein the structure layer is supplied using relief printing.

8. The method according to claim 1, wherein the silver ink is incorporated into the card stack above or below the structure layer.

9. The method according to claim 1, wherein the optical security element is generated by means of the silver ink and/or by means of the structure layer.

10. The method according to claim 1, wherein an outer transparent foil is configured with respect to the card body as a protective layer.

11. The method according to claim 1, wherein the silver ink is incorporated by means of screen printing technology.

12. A value document formed from a laminated foil stack forming a card body having an optical security element, having two consecutive transparent foils, wherein a silver ink and at least one structure layer are incorporated at the two transparent foils such that in interaction with the two transparent foils, the optical security element has a three-dimensional optical impression upon viewing, and wherein the silver ink is incorporated into the at least one structure layer.

13. An apparatus for supplying an optical security element in a value document, having:

a supplying unit devised for supplying a foil stack having two consecutive transparent foils, a lamination unit devised for laminating the foil stack for supplying a card body, wherein a silver ink and at least one structure layer are incorporated at the two transparent foils such that in interaction with the two transparent foils, the optical security element has a three-dimensional optical impression upon viewing, and wherein the silver ink is incorporated into the at least one structure layer.

14. A computer program product having control commands which implement the method according to claim 1.

* * * * *